US006132888A

United States Patent [19]

Yamamoto

[11] Patent Number: 6,132,888

[45] Date of Patent: Oct. 17, 2000

[54] STAINLESS STEEL WIRE AND PRODUCING METHOD THEREOF

[75] Inventor: Susumo Yamamoto, Hyogo, Japan

[73] Assignee: Sumitomo Electric Industries, Ltd., Osaka, Japan

[21] Appl. No.: 09/354,163

[22] Filed: Jul. 16, 1999

Related U.S. Application Data

[63] Continuation of application No. 08/921,342, Aug. 29, 1997, Pat. No. 5,989,732.

[30] Foreign Application Priority Data

Aug. 29, 1996 [JP] Japan ..... P 8-227987
Oct. 29, 1996 [JP] Japan ..... P 8-285747

[51] Int. Cl.[7] ..... B32B 15/04; B21C 1/00; B21C 9/02

[52] U.S. Cl. ..... 428/607; 428/632; 428/679; 428/685; 72/42; 72/47

[58] Field of Search ..... 428/685, 679, 428/632, 592, 607; 72/42, 47

[56] References Cited

U.S. PATENT DOCUMENTS

| | | | |
|---|---|---|---|
| 3,966,425 | 6/1976 | Takeo | 428/685 |
| 4,118,845 | 10/1978 | Schildbach | 29/419.1 |
| 4,197,340 | 4/1980 | Brown et al. | 508/156 |
| 4,246,047 | 1/1981 | Yamamoto et al. | 148/327 |
| 4,791,025 | 12/1988 | Hiromori et al. | 428/685 |
| 5,012,662 | 5/1991 | Tull | 508/158 |
| 5,273,667 | 12/1993 | Gill et al. | 508/111 |

FOREIGN PATENT DOCUMENTS 0 608 466 8/1994 European Pat. Off. .

OTHER PUBLICATIONS

Patent Abstracts of Japan, vol. 018, No. 127, (M–1569), Mar. 2, 1994 for JP 05 317954 A (Riken Seiko KK; Others: 01), Dec. 3, 1993.

*Primary Examiner*—John J. Zimmerman
*Attorney, Agent, or Firm*—Sughrue, Mion, Zinn, Macpeak & Seas, PLLC

[57] ABSTRACT

A stainless steel wire is plated with nickel (Ni) to a thickness of from not less than 1 $\mu$m to not more than 5 $\mu$m. An inorganic salt coat film mainly composed of at least one of potassium sulfate and borax (borate) and free from fluorine (F) or chlorine (Cl) is then deposited on the nickel (Ni) plate 2 as the substrate. The steel wire is then drawn to a reduction of area of not less than 60% to adjust the surface roughness thereof to a range of from 0.80 to 12.5 $\mu$mRz, preferably from 1.0 to 10.0 $\mu$mRz.

5 Claims, 1 Drawing Sheet

FIGURE
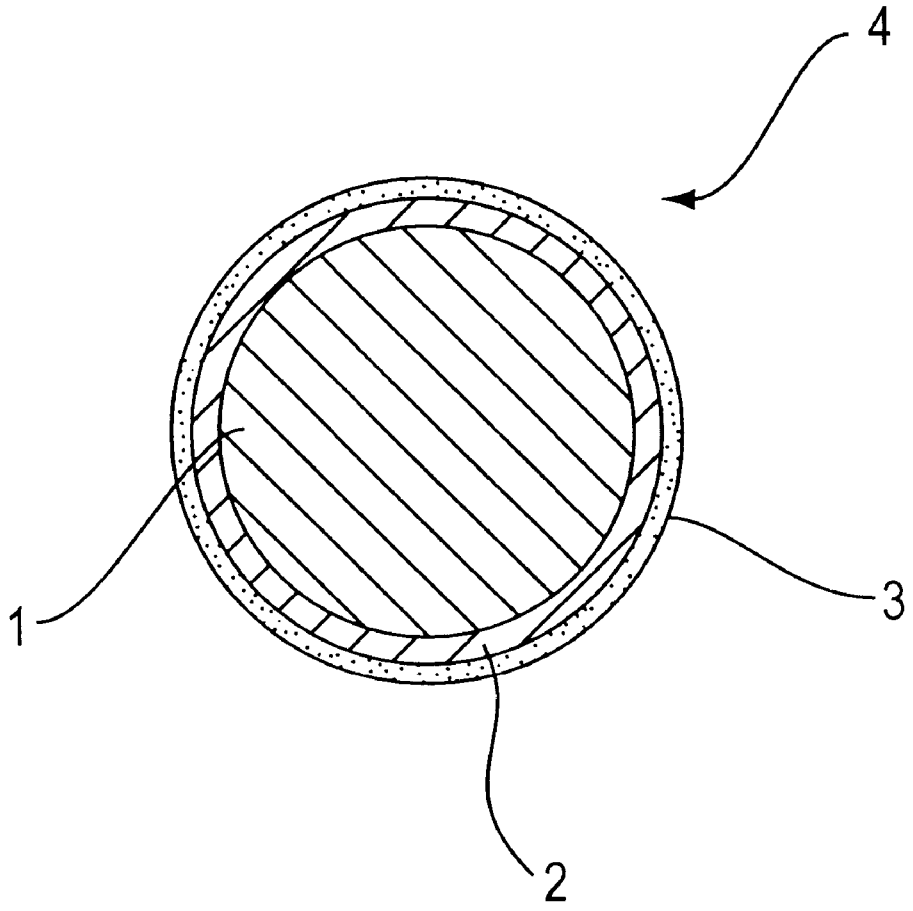

STAINLESS STEEL WIRE AND PRODUCING METHOD THEREOF

This is a continuation of application Ser. No. 08/921,342 filed Aug. 29, 1997, now U.S. Pat. No. 5,989,732, the disclosure of which is incorporated herein by reference.

BACKGROUND OF THE INVENTION

1. Field of the Invention

The present invention relates to a stainless steel wire. More particularly, the present invention relates to a stainless steel wire for automatic coiling for manufacturing a spring and a method for manufacturing the same.

2. Description of the Related Art

In general, stainless steel wires for a spring have a poor heat conduction and tend to undergo remarkable workhardening. Thus, these stainless steel wires do not exhibit sufficient surface lubricant property with tools. Accordingly, these stainless steel wires are inferior to carbon steel wires for spring in drawability at the wire manufacturing and workability at the subsequent step (e.g., coiling). In other words, these stainless steel wires are disadvantageous in that they can hardly be provided with sufficient surface lubricant property at wire drawing step and subsequent steps such as coiling step, thereby making it impossible to raise the production speed sufficiently or resulting in the production of spring products having unsettled shapes. Thus, as stainless steel wires for automatic coiling there have heretofore been used those obtained by a method which comprises plating the surface of stainless steel wires with nickel (Ni), and then drawing the wire to provide better surface lubricant property at wire drawing step and subsequent steps (Examined Japanese Patent Publication No. Sho. 44-14572).

Needless to say, these stainless steel wires are superior to stainless steel wires merely coated with a resin or the like. However, these stainless steel wires cannot necessarily meet sufficiently the recent growing demand for high performance stainless steel wires free from the foregoing disadvantages.

Further, a stainless steel wire has been recently disclosed obtained by plating a stainless steel wire with nickel (Ni) to a thickness of from not less than 1 $\mu$m to 5 $\mu$m, coating the stainless steel wire with a synthetic resin, and then drawing the stainless steel wire to a reduction of area of not less than 60% (Unexamined Japanese Patent Publication (kokai) No. Hei. 6-226330).

The stainless steel wire disclosed in Unexamined Japanese Patent Publication No. 6-226330 can be coiled at a high rate when worked into a spring. The products thus obtained have a uniform dimension. That is, the stainless steel wire exhibits a good coilability. However, the foregoing stainless steel wire cannot necessarily meet sufficiently the demand for precision coiling at an even higher rate free from the foregoing difficulties.

On the other hand, as the solvent for dissolving a resin containing fluorine (F) or chlorine (Cl) therein there is used freon, trichloroethylene, or the like. However, these solvents are considered to be a nuisance that causes environmental destruction. Further, the foregoing resin is disadvantageous in that the low temperature annealing (tempering) after working into spring, which is an essential process for the production of spring, causes fluorine (F) or chlorine (Cl) constituting the resin to evaporate and hurt the human body.

SUMMARY OF THE INVENTION

It is an object of the present invention to provide a stainless steel wire for automatic coiling which causes no environmental pollution and exhibits an excellent surface lubricant property.

A method for producing a stainless steel wire according to the present invention comprises the steps of: plating nickel having a thickness in the range of 1 $\mu$m to 5 $\mu$m on a stainless steel core wire comprising carbon (C) in an amount of not more than 0.15% by weight, silicon (Si) in an amount of not more than 1.00% by weight, manganese (Mn) in an amount of not more than 2.00%, nickel (Ni) in an amount of from not less than 6.50% by weight to less than 14.00% by weight and chromium (Cr) in an amount of from not less than 17.00% by weight to less than 20.00% by weight; generating an inorganic salt coat film comprising at least one of potassium sulfate and borax (borate) and free from chlorine (Cl) and fluorine (F) from an aqueous solution to be deposited on the nickel plate layer; and drawing the wire to a reduction of area of not less than 60%.

Thus produced stainless steel has a tensile strength of the stainless steel wire is not less than 160 kgf/mm$^2$ and a surface roughness thereof is in the range of 0.80 to 12.5 $\mu$mRz.

The producing method of the present invention does not require the use of any solvent that can cause environmental destruction. Further, the coat film cannot evaporate to produce any gas harmful to the human body when heated during spring forming.

In accordance with the producing method of the present invention, the formation of a nickel (Ni) plate and an inorganic salt deposit film reduces the frictional resistance of dies with stainless steel wire during drawing, making it possible to raise the drawing speed. Into the indentation on the coat film deposited on the surface of the steel wire, a powder lubricant is injected which then adds to surface lubricant property during drawing. In other words, the burning of stainless steel wire with dies during drawing can be prevented, prolonging the life of the drawing dies.

The injection of a lubricant into the indentation has another advantage. In other words, when formed into spring, the stainless steel wire for automatic coiling thus obtained shows an increased surface lubricant property and hence a reduced frictional resistance with respect to the spring forming tool (spring bending dies), making it possible to reduce the variation of spring shape in coiling.

The stainless steel wire for automatic coiling according to the present invention comprises a surface coat film composed of a higher melting inorganic salt rather than resin. Even when subjected to low temperature annealing (tempering), the spring products formed by the stainless steel is free from soot and discoloration. Accordingly, the spring products can be provided with the same clean surface conditions as seen before the low temperature annealing (tempering). Further, the stainless steel wire according to the present invention cannot produce any harmful gas.

BRIEF DESCRIPTION OF THE DRAWING

In the accompany drawing, FIGURE is a typical diagram of the cross section of a stainless steel wire for automatic coiling according to the present invention.

DETAILED DESCRIPTION OF THE INVENTION

Detailed description of the present invention will be described as follows.

A producing method according to the present invention comprises the steps of: plating nickel (Ni) having a thickness in the range of 1 μm to 5 μm on a stainless steel wire comprising carbon (C) in an amount of not more than 0.15% by weight (preferably not less than 0.05% by weight), silicon (Si) in an amount of not more than 1.00% by weight (preferably not less than 0.1% by weight), manganese (Mn) in an amount of not more than 2.00% (preferably not less than 0.1% by weight), nickel (Ni) in an amount of from not less than 6.50% by weight to less than 14.00% by weight and chromium (Cr) in an amount of from not less than 17.00% by weight to less than 20.00% by weight, generating an inorganic salt coat film mainly comprising at least one of potassium sulfate and borax (borate) and free from chlorine (Cl) and fluorine (F) from an aqueous solution to be deposited on the nickel plate layer as a substrate, and then drawing the wire to a reduction of area of not less than 60%. The inorganic salt is dissolved in water or hot water, and then applied to the surface of a nickel(Ni)-plated stainless steel wire. The stainless steel wire is then dried to remove the water content from the coat layer so that a coat film is deposited on and attached to the substrate. This method does not require the use of any coat film and solvent that can pollute global environment and thus causes no pollution.

The stainless steel wire for automatic coiling obtained by the producing method according to the present invention comprises a nickel (Ni) plate layer having a thickness of from not less than 0.3 μm to not more than 1.7 μm and a coat film mainly comprising at least one of potassium sulfate and borax (borate) and free from chlorine (Cl) and fluorine (F) deposited on said nickel layer and has a tensile strength of not less than 160 kgf/mm$^2$ and a surface roughness of from 0.8 to 12.5 μmRz. The surface roughness of the stainless steel wire is preferably from 1.0 to 10.0 μmRz to further enhance the foregoing effect.

The surface roughness (according to JIS B 0601) of the stainless steel wire for automatic coiling which has been finally drawn is defined to be from 0.8 μmRz to 12.5 μmRz as disclosed in Unexamined Japanese Patent Publication (kokai) No. 6-226330. To this end, it is necessary that the surface roughness of the unplated stainless steel wire or the plating conditions (e.g., liquid composition, pH, temperature, current, stirring) be controlled. Since stainless steel wire for automatic coiling is used for producing a spring, the tensile strength of the stainless steel wire for automatic coiling needs to be not less than 160 kgf/mm$^2$.

Incidentally, the surface roughness of the stainless steel wire for automatic coiling which has been finally drawn is preferably defined to be from 1.0 μmRz to 10 μmRz.

When the inorganic salt solution from generating a coat film is deposited undergoes chemical reaction with the nickel (Ni) plate as a substrate, a reaction product such as nickel sulfate, nickel borate and nickel oxide is produced. In this case, the surface coat film is baked and discolored by the low temperature annealing (tempering) effected after coiling. Therefore, it is important that the solution of an inorganic salt in water or hot water which has been applied and attached to the substrate be dried to cause the inorganic salt to be deposited on the substrate without causing any chemical reaction.

It is also important that the inorganic salt be not dissolved in a solution which undergoes chemical reaction with stainless steel, such as hydrochloric acid and phosphoric acid. A solvent which does not react with stainless steel such as water and hot water should be absolutely used. In this case, the surface coat film cannot be baked during the low temperature annealing (tempering). The resulting steel wire has a clean surface. The surface coat film is free of chlorine (Cl) or fluorine (F) and thus doesn't produce any gas that pollutes environmental environment or any gas harmful to the human body.

EXAMPLES

The present invention will be further described in the following examples as compared with comparative examples and conventional examples. The stainless steel wire was SUS304 (corresponding to JIS G 4314). The chemical composition of two kinds (A, B) of the stainless steel wire is set forth in Table 1.

TABLE 1

| Kind of | Chemical composition (wt-%) | | | | | | | |
|---|---|---|---|---|---|---|---|---|
| steel | C | Si | Mn | P | S | Ni | Cr | Mo |
| 304A | 0.077 | 0.542 | 1.27 | 0.025 | 0.010 | 8.55 | 18.58 | 0.02 |
| 304B | 0.076 | 0.57 | 1.31 | 0.022 | 0.008 | 8.69 | 18.71 | 0.03 |

A typical diagram of the cross section of a stainless steel wire 4 for automatic coiling is shown in FIG. 1. A 2.3 mm diameter stainless steel wire 1 having the chemical composition set forth in Table 1 in which a carbide had been solid-dissolved and recrystallized in the substrate metal was dipped in an ordinary Watts bath to have a nickel (Ni) plate 2 deposited thereon. This treatment was effected for all samples except E, F, and G set forth in Table 2. These stainless steel wires plated with nickel (Ni) had a metal plate thickness and a surface roughness (determined by means of a contact finger electrical surface roughness meter and represented by 10-point average roughness according to JIS B 0601) as set forth in Table 2.

All the samples except E, F and G were each then coated with a film 3 on the nickel (Ni) plate 2 as set forth in Table 2. The samples E, F and G were each then coated with a film 3 directly on the stainless steel wire 1 as set forth in Table 2. In other words, the stainless steel wire plated with nickel (Ni) is dipped in a solution of an inorganic salt of the present invention set forth in Table 2 in hot water, and then dried to cause the inorganic salt to be deposited on the surface of the nickel (Ni) plate.

A solution of an inorganic salt mainly consisting of as a main component at least one of potassium sulfate and borax (borate) does not undergo chemical reaction with nickel (Ni). When the inorganic salt which has been applied to the substrate is dried (including spontaneous drying, not to mention of drying under heating, which is effective for the enhancement of drying speed) to remove the water content therefrom, whereby the inorganic salt is deposited on the surface of the nickel (Ni) plate. The inorganic salt thus deposited is merely attached to the nickel (Ni) as the substrate.

The coat film thus formed follows the surface roughness of the nickel (Ni) plate as the substrate. The surface roughness of the coat film in turn has an effect on the surface roughness of the drawn stainless steel wire as shown in Table 3. During wire drawing, a powder lubricant for drawing enters into the indentation on the surface coat film (which cannot be identified for its shape but can be measured by means of a contact finger electrical surface roughness meter). Thus, the stainless steel wire can exhibit an even better surface lubricant property at the drawing step. and the subsequent coiling step.

TABLE 2

| Sample | Kind of steel | Thickness of Ni plate (μm) | Ni surface roughness (μmRz) | Coat film |
|---|---|---|---|---|
| Conventional Example | | | | |
| A | 304A | 3 | 12.3 | Ethylene chloride |
| B | 304A | 3.4 | 6.3 | Ethylene tetrafluoride |
| C | 304A | 3 | 32 | Ethylene triflorochloride |
| D | 304A | 3 | 12.3 | None |
| E | 304B | 0 | — | Ferbond (oxalic acid coat film) |
| Comparative Example | | | | |
| F | 304B | 0 | — | Potassium sulfate |
| G | 304B | 0 | — | Potassium sulfate (60%) + borax (40%) |
| H | 304B | 0.5 | 12.3 | Potassium sulfate (60%) + borax (40%) |
| I | 304B | 8 | 12.3 | Potassium sulfate (60%) + borax (40%) |
| J | 304B | 3 | 1.6 | Potassium sulfate (60%) + borax (40%) |
| K | 304B | 3 | 50 | Potassium sulfate (60%) + borax (40%) |
| Example | | | | |
| L | 304B | 3 | 12.3 | Potassium sulfate (60%) + borax (40%) |
| M | 304B | 3 | 12.3 | Potassium sulfate |
| N | 304B | 3 | 12.3 | Borax |
| O | 304B | 1.2 | 12.3 | Potassium sulfate (60%) + borax (40%) |
| P | 304B | 4.5 | 12.3 | Potassium sulfate (60%) + borax (40%) |
| Q | 304B | 3 | 2.5 | Potassium sulfate (60%) + borax (40%) |
| R | 304B | 3 | 32 | Potassium sulfate (60%) + borax (40%) |
| S | 304B | 3 | 3.2 | Potassium sulfate (60%) + borax (40%) |
| T | 304B | 3 | 25 | Potassium sulfate (60%) + borax (40%) |

(Samples E, F and G each exhibit a surface roughness of 6.3, which is the surface roughness of single stainless steel free of nickel (Ni) plate and coat film.)

(Wire drawing test)

The stainless steel wires consisting a nickel (Ni) plate and a coat film and the stainless steel wires consisting of a coat film alone as set forth in Table 2 above were each drawn to a diameter of 1.0 mm. The surface roughness of these stainless steel wires thus drawn was then determined according to JIS B 0601. The continuous drawing through a plurality of dies was effected under ordinary conditions. In some detail, as the drawing machine there was used a straight type continuous drawing machine. As the dies for drawing the steel wire to reduce the section area of the wire there was used a sintered diamond dies. As the powder lubricant for wire drawing there was used a calcium stearate lubricant.

The measurements of the surface roughness (according to JIS B 0601) of the wire thus drawn are set forth in Table 3. The surface roughness of the wire was measured at the surface of the coat film 3. However, since the coat film 3 was thin and uniform, it can be thought that the surface roughness of the coat film 3 follows that of the nickel (Ni) plate, if any. Sample K had a great surface roughness and thus was not adapted to be used as stainless steel wire for high quality spring. Therefore, Sample K was not subjected to spring working test.

TABLE 3

| Sample | Surface roughness of drawn wire (μmRz) |
|---|---|
| Conventional Example | |
| A | 3.2 |
| B | 1.6 |
| C | 12.3 |
| D | 3.2 |
| E | 3.2 |
| Comparative Example | |
| F | 3.2 |
| G | 3.2 |
| H | 3.2 |
| I | 3.2 |
| J | 0.4 |
| K | 25 |
| Example | |
| L | 3.2 |
| M | 3.2 |
| N | 3.2 |
| O | 3.2 |
| P | 3.2 |
| Q | 0.8 |
| R | 12.3 |
| S | 1.0 |
| T | 10.0 |

(Spring forming test)

All the foregoing steel wires thus drawn except Comparative Example K were worked into a spring by an automatic coiling machine.

For spring forming, a precision automatic coiling machine was used. 300 pieces of spring having the following dimension were formed from each of these steel wires.

| | |
|---|---|
| Wire diameter: | 1.0 mm |
| Inner diameter of coil: | 10.0 mm |
| Total number of coils: | 8.5 |
| Number of active coils (turn which effectively works under load): | 7.5 |
| Free length (target free length): | 40.0 mm |

The mean and standard deviation of the free length (height of spring under no load, which is the result of the production with 40.0 mm as the target) of the springs thus produced were then determined. The results are set forth in Table 4. The stainless steel wire of Comparative Example I had a thick metal plate which was peeled off when coiled. Then, the coiling of the sample was dropped.

TABLE 4

| Sample | Mean of free length (mm) | Standard deviation |
|---|---|---|
| Conventional Example | | |
| A | 40.007 | 0.126 |
| B | 40.004 | 0.120 |
| C | 40.005 | 0.126 |
| D | 40.035 | 0.171 |
| E | 40.010 | 0.620 |

TABLE 4-continued

| Sample | Mean of free length (mm) | Standard deviation |
|---|---|---|
| Comparative Example | | |
| F | 40.520 | 0.755 |
| G | 40.733 | 0.698 |
| H | 40.535 | 0.322 |
| J | 40.100 | 0.278 |
| Example | | |
| L | 40.005 | 0.062 |
| M | 40.004 | 0.082 |
| N | 39.998 | 0.085 |
| O | 40.006 | 0.085 |
| P | 39.996 | 0.054 |
| Q | 40.010 | 0.115 |
| R | 40.009 | 0.108 |
| S | 39.997 | 0.079 |
| T | 40.021 | 0.081 |

Table 4 shows that the springs coiled from the stainless steel wires for automatic coiling according to the present invention had little varied free lengths as can be confirmed in Examples L to T. Further, Examples L, M, N, O, P, S and T, which exhibit a surface roughness of from 1.0 to 10.0 μmRz, showed an extremely small variation in free length. The ratio of actual free length to target free length of spring is referred to as "free length ratio", by which the quality of the spring can be judged.

In general, precision springs having a free length ratio falling within ±0.1% are considered good. Ultraprecision springs having a free length ratio falling within ±0.05% are considered good. The percentage of the number of products falling outside the above defined range in the total number of products (300) is regarded as percent defective. The results are set forth in Table 5. (All the figures in Table 5 indicate percentage.)

TABLE 5

| Sample Criterion of evaluation | Conventional Example | | | | | Comparative Example | | | |
|---|---|---|---|---|---|---|---|---|---|
| | A | B | C | D | E | F | G | H | J |
| Free length ratio | | | | | | | | | |
| Within ±0.1% | 0 | 0 | 0 | 1.0 | 26 | 30 | 29 | 13 | 11 |
| Within ±0.05% | 4.3 | 4.0 | 4.3 | 14 | 53 | 69 | 58 | 24 | 18 |

| Sample Criterion of evaluation | Example | | | | | | | | |
|---|---|---|---|---|---|---|---|---|---|
| | L | M | N | O | P | Q | R | S | T |
| Free length ratio | | | | | | | | | |
| Within ±0.1% | 0 | 0 | 0 | 0 | 0 | 0 | 0 | 0 | 0 |
| Within ±0.05% | 0 | 1.7 | 2.3 | 2.3 | 0 | 3.0 | 3.7 | 2.3 | 1.3 |

(The figures Indicate the percentage of the number of products falling outside the criterion of free length ratio: within ±0.1% or ±0.05%.)

Table 5 shows that the examples of the present invention had a low percent defective as compared with the comparative examples and conventional examples. Among the examples of the present invention, Examples L, M, N, O, P, S and T, which had a surface roughness defined to a range of from 1.0 to 10.0 μmRz, showed an extremely small percent defective.

50 pieces were taken out from each group of the spring products. These samples were then subjected to low temperature annealing (tempering) at a temperature of 350° C. for 15 minutes. The gas thus produced was then checked to see if it has any offensive smell. Further, the spring products thus tempered were observed for surface conditions (occurrence and degree of discoloration). The results are set forth in Table 6.

TABLE 6

| Sample | Surface conditions | Produced gas |
|---|---|---|
| Conventional Example | | |
| A | No discoloration | Offensive smell |
| B | " | " |
| C | " | " |
| D | Discolored in brown | No offensive smell |
| E | Discolored in dark brown spots | " |
| Comparative Example | | |
| F | No discoloration | No offensive smell |
| G | " | " |
| H | " | " |
| J | " | " |
| Example | | |
| L | No discoloration | No offensive smell |
| M | " | " |
| N | " | " |
| O | " | " |
| P | " | " |
| Q | " | " |
| R | " | " |
| S | " | " |
| T | " | " |

Table 6 shows that among the conventional examples, Examples A, B and C showed a relatively small variation in coiling but produced a smell offensive to the nose (possibly a gas containing chlorine (Cl) or fluorine (F)), and Examples D and E showed a great variation in coiling and a remarkable discoloration and thus cannot be used as precision springs. It is thought that the discoloration of Sample E is attributed to the color of an oxide film produced by the oxidation of the surface of the spring. It is also thought that the color of Sample E is produced when some reaction products (oxide and hydroxide) obtained by the reaction of the stainless steel wire free of nickel (Ni) and coat film with oxalic acid is baked.

Comparative Examples F, G, H and J neither showed discoloration nor produced stinking gas and thus are good in this respect. However, these comparative examples showed a great variation of spring shape in coiling as can be seen in Tables 4 and 5.

Examples L, M, N, O, P, Q, R, S, and T neither showed discoloration nor produced stinking gas when subjected to low temperature annealing (tempering). As can be seen in Tables 4 and 5, the stainless steel wires of these examples showed an extremely small variation of spring shape in coiling and thus can provide excellent precision spring products.

As mentioned above, the coat film obtained by the method according to the present invention is free from fluorine (F) or chlorine (Cl), which has adverse effects on the global environment or the human body. Another problem is that the application of an organic resin coat containing fluorine (F) or chlorine (Cl) to the surface of stainless steel wire requires the use of flon or tricrene, which has adverse effects on the global environment, as a solvent. The stainless steel wire consisting of a coat film thus obtained provides a stainless steel wire for automatic coiling which shows little variation of spring shape in coiling when formed into a spring. Further, the stainless steel wire thus coiled is advantageous in that it neither shows discoloration nor produces any gas harmful to the human body or stinking smell when subjected to low temperature annealing (tempering).

In the foregoing examples, SUS304 was used. The present invention can be also applied to an austenite stainless steel wire (stainless steel comprising carbon (C) in an amount of not more than 0.15% by weight (preferably not less than 0.05% by weight), silicon (Si) in an amount of not more than 1.00% by weight (preferably not less than 0.1% by weight), manganese (Mn) in an amount of not more than 2.00% by weight (preferably not less than 0.1% by weight), nickel (Ni) in an amount of from not less than 6.50% by weight to less than 14.00% by weight, and chromium in an amount of from not less than 17.00% by weight to less than 20.00% by weight) which develops its tensile strength when subjected to working such as drawing can be applied as in the examples of the present invention.

As the composition of the inorganic salt coat film to be used in the examples of the present invention, there have been exemplified potassium sulfate and borax (borate). The examples of the present invention can be also applied to other inorganic salts such as salt obtained by the neutralization of a strong alkali (e.g., sodium sulfate, lithium sulfate, sodium sulfite, potassium sulfite, sodium molybdate, sodium silicate, potassium silicate) with a strong acid (excluding hydrochloric acid, phosphoric acid and other acids which react with stainless steel and nitric acid, which accelerates the passivation of stainless steel).

What is claimed is:

1. A method for producing a stainless steel wire, comprising the steps of:

plating nickel having a thickness in the range of 1 $\mu$m to 5 $\mu$m on a stainless steel core wire comprising carbon (C) in an amount of not more than 0.15% by weight, silicon (Si) in an amount of not more than 1.00% by weight, manganese (Mn) in an amount of not more than 2.00%, nickel (Ni) in an amount of from not less than 6.50% by weight to less than 14.00% by weight and chromium (Cr) in an amount of from not less than 17.00% by weight to less than 20.00% by weight;

generating an inorganic salt coat film comprising at least one of potassium sulfate and borax (borate) and free from chlorine (Cl) and fluorine (F) from an aqueous solution to be deposited on said nickel plate layer; and drawing said wire to a reduction of area of not less than 60%.

2. The producing method according to claim 1, wherein the amount of said carbon is not less than 0.05% by weight, the amount of said silicon is not less than 0.1% by weight, and the amount of said manganese is not less than 0.1% by weight.

3. A stainless steel wire comprising:

a stainless steel core wire comprising carbon (C) in an amount of not more than 0.15% by weight, silicon (Si) in an amount of not more than 1.00% by weight, manganese (Mn) in an amount of not more than 2.00%, nickel (Ni) in an amount of from not less than 6.50% by weight to less than 14.00% by weight and chromium (Cr) in an amount of from not less than 17.00% by weight to less than 20.00% by weight;

a nickel (Ni) plate layer having a thickness of from not less than 0.3 $\mu$m to not more than 1.7 $\mu$m on said stainless steel core wire; and an inorganic salt coat film comprising at least one of potassium sulfate and borax (borate) and free from chlorine (Cl) and fluorine (F) deposited on said nickel layer;

wherein a tensile strength of said stainless steel wire is not less than 160 kgf/mm$^2$ and a surface roughness thereof is in the range of 0.80 to 12.5 $\mu$mRz.

4. The stainless steel wire according to claim 3, wherein said surface roughness is from 1.0 to 10.0 $\mu$mRz.

5. The stainless steel wire according to claim 3, wherein the amount of said carbon is not less than 0.05% by weight, the amount of said silicon is not less than 0.1% by weight, and the amount of said manganese is not less than 0.1% by weight.

* * * * *